US007492137B2

(12) United States Patent
Yamada

(10) Patent No.: US 7,492,137 B2
(45) Date of Patent: Feb. 17, 2009

(54) SERIES REGULATOR AND DIFFERENTIAL AMPLIFIER CIRCUIT THEREOF

(75) Inventor: Kouhei Yamada, Matsumoto (JP)

(73) Assignee: Fuji Electric Device Technology Co., Ltd. (JP)

( * ) Notice: Subject to any disclaimer, the term of this patent is extended or adjusted under 35 U.S.C. 154(b) by 287 days.

(21) Appl. No.: 11/384,861

(22) Filed: Mar. 20, 2006

(65) Prior Publication Data

US 2007/0063686 A1 Mar. 22, 2007

(30) Foreign Application Priority Data

May 16, 2005 (JP) ..... 2005-142071

(51) Int. Cl.
*G05F 1/40* (2006.01)

(52) U.S. Cl. ..... 323/280; 323/316

(58) Field of Classification Search ..... 323/224, 323/312–316, 270, 274, 280, 284
See application file for complete search history.

(56) References Cited

U.S. PATENT DOCUMENTS 4,282,477 A * 8/1981 Ahmed ..... 323/312
6,897,715 B2 * 5/2005 Barber et al. ..... 323/316
7,068,018 B2 * 6/2006 Kanakubo ..... 323/274

FOREIGN PATENT DOCUMENTS

JP 2002-258954 A 9/2002

* cited by examiner

*Primary Examiner*—Jessica Han
(74) *Attorney, Agent, or Firm*—Rossi, Kimms & McDowell, LLP

(57) ABSTRACT

A series regulator for supplying a stable output voltage to a load has a differential amplifier circuit and an output stage. The output stage has an output control transistor that supplies the output voltage in accordance with a control signal, and a voltage divider circuit that divides the output voltage and outputs the divided voltage. The differential input stage includes a differential pair (source-coupled pair) of two NMOS transistors, an NMOS transistor, and a current mirror circuit formed by PMOS transistors. The differential input stage detects a differential voltage between a reference voltage and the divided voltage output from the voltage divider circuit. The differential amplifier circuit also has an amplification stage including a PMOS transistor that has a resistor connected between its gate and drain and that has its drain connected to a node, and an NMOS transistor that supplies a current proportional to a constant current to the PMOS transistor. The series regulator/differential amplifier circuit allows both low output resistance and sufficient DC gain without increasing bias current.

4 Claims, 9 Drawing Sheets

SERIES REGULATOR AND DIFFERENTIAL AMPLIFIER CIRCUIT THEREOF

BACKGROUND

As the recent electronic devices, such as portable telephone and PDA (personal digital assistant), use more and more electronic components, the power sources for these devices need to cope with a broad range of output voltage and load current. As an example of series regulator power-supply circuit that forms such a power source, an LDO (low dropout) voltage regulator (linear regulator) employing a MOSFET (hereinafter referred to as MOS transistor) for an output control transistor (path transistor) is used to realize low dropout, as disclosed in, for example, JP-A-2002-258954.

FIG. 8 is a circuit diagram showing a conventional series regulator 90. The numerals placed near each transistor in FIG. 8 represent the number of units and the size of the transistor (m (units)×W (gate width) [μm]/L (gate length)[μm]). These numerals will be described in detail later. The series regulator 90 has an output control transistor M91 that receives a power supply voltage $V_{IN90}$ input and outputs a stable output voltage $V_{OUT90}$. It also has voltage resistors R91 and R92. It also includes a differential input stage including, NMOS transistors M92, M93, and M95, and PMOS transistors M96 and M97. It also has an NMOS transistor M94. The PMOS transistors M96 and M97 form a current mirror circuit and the NMOS transistors M94 and M95 form a current mirror circuit. The current mirror circuit formed by the NMOS transistors M94 and M95 is a constant-current circuit that supplies a current proportional to a current $I_{90}$ to the differential input stage. The NMOS transistors M92 and M93, which form the differential pair of the differential input stage, also can be referred to as source-coupled pair because the sources of the two transistors are connected to each other.

A load resistance $R_{L90}$ and a capacitance $C_{L90}$ are connected to an output terminal out90 of the series regulator 90. In this circuit, negative feedback is applied so that an output voltage $V_{OUT90}$ and a reference voltage $V_{REF90}$ has the relation expressed by the following equation (1):

$$V_{OUT90}=(R91+R92)V_{REF90}/R92 \quad (1).$$

The characteristics of the feedback loop of this series regulator will now be described. Main poles in the feedback loop normally exist at a node X90 and a node Y90. The pole of the node X90 is substantially decided by the load resistance $R_{L90}$ and the capacitance $C_{L90}$, and shifts to the high-frequency side as the load resistance $R_{L90}$ decreases. If the frequency at the pole of the node Y90 is not sufficiently higher than the frequency at the pole of the node X90, for example, if the frequency at the pole of the node Y90 is not higher than the frequency at the pole of the node X90 by two digits (=40 dB/(20 dB/decade)) or more in the case where the DC gain is 40 dB, a phase lag by the node Y90 is superposed on a phase lag by the node X90 at a frequency lower than the UG frequency (frequency at which the open loop gain of the feedback loop is 1 (0 dB)) at the node X90, and the phase margin is extremely reduced, thus lowering stability. Therefore, the frequency must be set at the pole of the node Y90 in accordance with the required output current and DC gain.

The pole of the node Y90 is decided by the product of an output resistance Ry90 of the node Y90 and a capacitance Cy90 substantially equal to the gate capacitance Cgs90 of the output control transistor M91 (total capacitance component connected to the node Y90). Since the size of the device of the output control transistor M91 is decided by the current supply capability of the series regulator, it is difficult to change the size. Therefore, the output resistance Ry90 must be reduced to provide a high frequency at the pole of the node Y90.

FIG. 9 is a circuit diagram showing another conventional series regulator 90*a*. The same parts as in FIG. 8 are denoted by the same numerals. Here, the series regulator 90*a* has resistors R96 and R97. Even when it is difficult to adjust the output resistance Ry90 by using a bias current of the output control transistor M91 and the channel length L of the device, Ry90 can be adjusted to be approximately equal to R97 by providing the resistors R96 and R97 having equal resistance values. However, if the output resistance Ry90 is reduced, the DC gain of the differential amplification stage decided by the product gm90·Ry90 of the output resistance Ry90 and the transconductance gm90 of the differential pair formed by the transistors M92 and M93 is reduced. For example, if the output resistance Ry90 is reduced by one digit, the transconductance gm90 of the differential pair must be increased by one digit to maintain the DC gain of the differential amplification stage. To increase the transconductance gm90 by one digit, when the volt-ampere characteristic of the transistors M92 and M93 follows the square law and the device size is not to be changed, the bias current must be increased by two digits. Even when the channel width of the transistors M92 and M93 is increased by one digit, the bias current must be increased by one digit.

Specifically, the bias current $I_{90}$ of each of the transistors M92 and M93 can be expressed by the following equation (2):

$$I_{90}=K(V_{GS}-Vth)^2 \quad (2),$$

where K represents the transconductance parameter (constant), $V_{GS}$ represents the gate-source voltage, and Vth represents the threshold voltage of the transistors M92 and M93.

The transconductance gm90 can be expressed by the following equation (3):

$$gm90=dI/dV=2K(V_{GS}-Vth) \quad (3).$$

Thus, to increase the transconductance gm90 by one digit, ($V_{GS}$−Vth) must be increased by one digit. According to the equation (2), the bias current $I_{90}$ is increased by two digits. Therefore, it is difficult to realize lower power consumption.

Although JP-A-2002-258954 discloses realizing lower power consumption, it does not disclose any amplifier circuit that achieves both low output resistance and sufficient DC gain. In terms of this, JP-A-2002-258954 is the opposite because it uses many current mirror circuits.

Accordingly, there still remains a need to improve both low output resistance and sufficient DC gain without increasing the bias current in a series regulator. The present invention addresses this need.

SUMMARY OF THE INVENTION

The present invention relates to a series regulator and a differential amplifier circuit thereof, particularly for supplying a stable output voltage to a load.

One aspect of the present invention is a differential amplifier circuit for outputting a differential signal. The differential amplifier circuit can include a differential input stage for detecting a differential voltage between two voltage sources, and an amplification stage having a MOS transistor and a resistor having a predetermined resistance connected to the gate and the drain of the MOS transistor, and a constant-current circuit connected in series with the MOS transistor. The differential input stage has an output connected to the gate of the MOS transistor, and a connecting part between the MOS transistor and the constant-current circuit can serve as an output terminal of the amplification stage.

The differential input stage can include a pair of MOS transistors, with the source sides thereof coupled together. The two voltage sources can be input to the respective gate sides of the pair of MOS transistors to detect the differential voltage therebetween.

Another aspect of the present invention is a series regulator for supplying a stable output voltage to a load. The series regulator includes the differential amplifier circuit described above. It can further include an output control transistor that supplies the output voltage in accordance with a control signal from the differential amplifier circuit, and a voltage divider circuit that divides the output voltage and outputs the divided voltage to the differential amplifier circuit. The differential amplifier circuit outputs the control signal to the output control transistor in accordance with a differential voltage of difference between a preset reference voltage and the divided voltage output from the voltage divider circuit. The differential input stage detects the differential voltage between the reference voltage and the divided voltage output from the voltage divider circuit.

DETAILED DESCRIPTION

Figure 1:
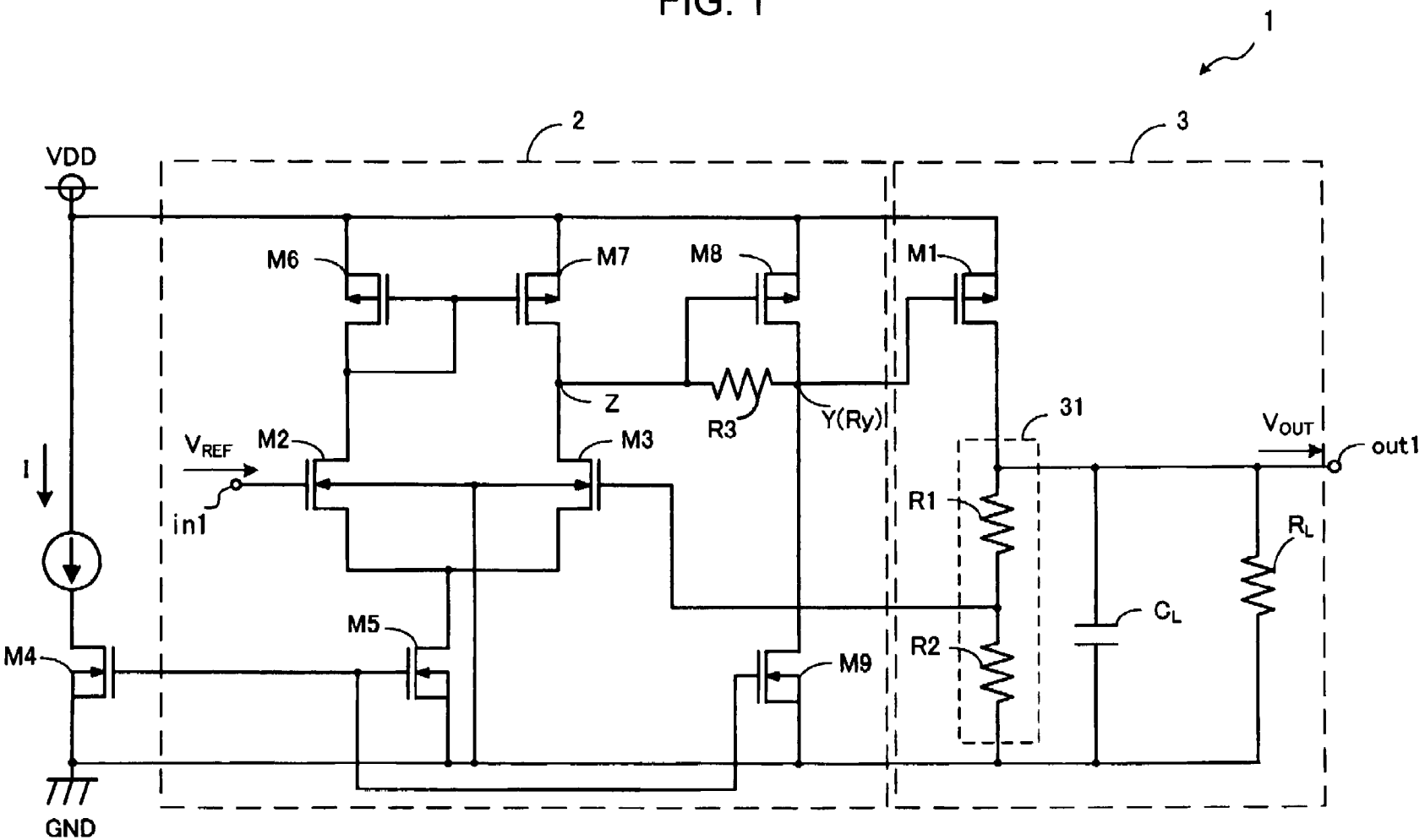
FIG. 1 is a circuit diagram showing a first embodiment of a series regulator according to the present invention.

Referring to FIG. 1, which illustrates a circuit diagram of a first embodiment of a series regulator 1, the series regulator 1 has a differential amplifier circuit 2, and an output stage 3 that is controlled by the differential amplifier circuit 2.

The output stage 3 can include an output control transistor Ml of PMOS transistor operating as a variable resistor, a voltage divider circuit 31 that detects variation of output voltage $V_{OUT}$, and a capacitance $C_L$ and load resistance $R_L$ connected to the drain of the output control transistor M1 to stabilize the loop. A power supply voltage VDD is output to the capacitance $C_L$ and load resistance $R_L$ through the output control transistor M1. The output control transistor M1 has its gate connected to a node Y of the differential amplifier circuit 2 and has its drain connected to the voltage divider circuit 31 and an output terminal out1 of the series regulator where the output voltage $V_{OUT}$ is output.

The differential amplifier circuit 2 has a differential input stage including a differential pair (source-coupled pair) of two NMOS transistors M2 and M3, an NMOS transistor M5, and a current mirror circuit formed by PMOS transistors M6 and M7. The differential amplifier circuit 2 also has an amplification stage including a PMOS transistor M8 that has a resistor R3 having a predetermined resistance connected to its gate and drain sides. Its drain side and the resistor R3 are connected to the node Y, and an NMOS transistor M9 that supplies a current proportional to a constant current I to the transistor M8 is connected in series therewith. A connecting part between the transistor M8 and the transistor M9 serves as an output terminal (output part) of the amplification stage. The transistor M5 forms a current mirror together with an NMOS transistor M4 and supplies a current proportional to a constant current I to the differential input stage.

A reference voltage $V_{REF}$ is supplied to an input terminal in1 connected to the gate of the transistor M2. The gate of the transistor M3 is connected to the voltage divider circuit 31. The voltage divider circuit 31 includes two resistors R1 and R2 connected in series between the output terminal out1 of the series regulator 1 and the ground. The divided voltage from this voltage divider circuit 31 is supplied to the gate of the transistor M3.

The operation of the series regulator 1 will now be described. The output control transistor M1 outputs an output voltage $V_{OUT}$ in accordance with a control signal output from the amplification stage. The voltage divider circuit 31 performs resistance voltage division of the output voltage $V_{OUT}$ and inputs the divided voltage to the gate of the transistor M3. The differential input stage compares the divided voltage with the reference voltage $V_{REF}$, detects the differential voltage, and outputs a voltage or current corresponding to the differential voltage. For a small signal, the output current is proportional to the differential voltage.

In the following description, this output current is considered. The transistor M8 converts the output current of the differential stage to a voltage to generate a control signal (differential signal) and outputs the control signal to the output control transistor M1. In this case, if the reference voltage $V_{REF}$ is larger, the output current of the output control transistor M1 increases and the output voltage $V_{OUT}$ rises. If the divided voltage is larger, the output current of the output control transistor M1 is restrained and the output voltage $V_{OUT}$ drops.

Figure 2:
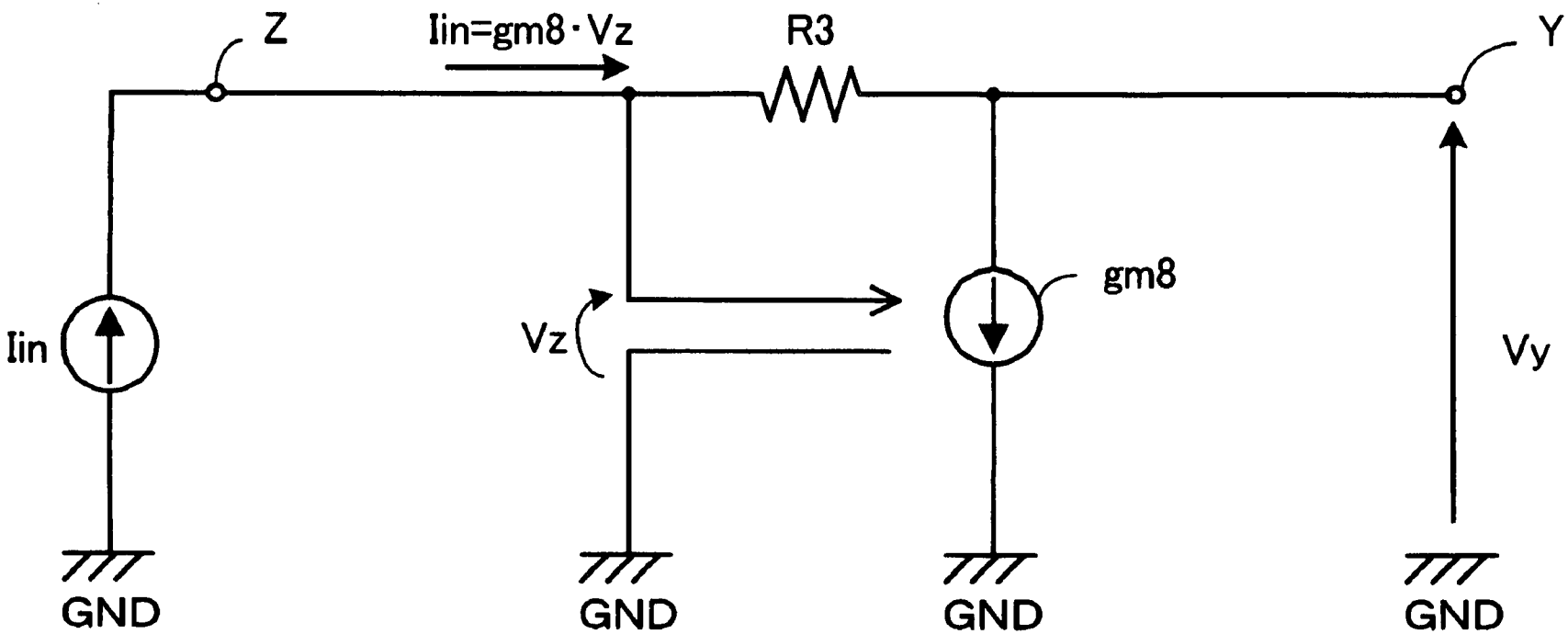
FIG. 2 is a circuit diagram showing an equivalent circuit between nodes of a differential input stage and an amplification stage of a differential amplifier circuit.

The relation between the output resistance at the node Y and each element will now be described. FIG. 2 shows an equivalent circuit between the nodes of the differential input stage and the amplification stage of the differential amplifier circuit. In FIG. 2, gm8 represents the transconductance of the transistor M8, Iin represents the output current from a node Z decided by the differential input of the transistors M2 and M3, Vy represents the voltage at the node Y, and Vz represents the voltage at the node Z. Here, to simplify the description, the capacitance component accompanying the node Z is small and its influence can be ignored. If the transconductance of the differential circuit formed by the transistors M2, M3 and M5 to M7 is gmdif, the current Iin can be expressed by the following equation (4):

$$Iin=gmdif\cdot(V_{OUT}\cdot R2(R1+R2)-V_{REF}) \quad (4).$$

If the current does not flow out from the node Y, Iin is equal to a current flowing in accordance with the transconductance gm8 of the transistor M8. Therefore, the current Iin can be expressed by the following equation (5):

$$Iin=gm8\cdot Vz \quad (5).$$

Meanwhile, the voltage Vy can be expressed by the following equation (6):

$$Vy=Vz-R3\cdot Iin=(1-R3\cdot gm8)Vz \quad (6).$$

As the equation (5) is substituted into the equation (6), the following equation is provided:

$$Vy=(1-R3\cdot gm8)\cdot Iin/gm8 \quad (7).$$

Thus, the transimpedance Zzy=Vy/Iin between Z and Y can be expressed by the following equation (8):

$$Zzy=(1-R3\cdot gm8)/gm8 \quad (8).$$

Meanwhile, if the output resistance at the node Y is Ry, the resistance Ry can be found by finding the output voltage Vy in the case of opening the node Z and outputting $I_{OUT}$ from the node Y in FIG. 2, and then calculating Vy/($-I_{OUT}$). In this case, the current flowing in accordance with the transconductance gm8 of the transistor M8 is the output current $I_{OUT}$. To generate $I_{OUT}$ by the transconductance gm8, a voltage of Vz=$-I_{OUT}$/gm8 must be generated at the node Z. Since the node Z is open, no current flows through the resistor R3 and no voltage drops across the resistor R3. Therefore, the potential Vy at the node Y is equal to Vz. To summarize the above, the resistance Ry can be expressed by the following equation (9):

$$Ry=Vy/(-I_{OUT})=Vz/(-I_{OUT})=1/gm8 \quad (9).$$

As expressed by the equation (9), the resistance Ry is given by the reciprocal of the transconductance gm8. The gain of the differential amplifier circuit 2 is decided by the transimpedance Zzy between Z and Y and the transconductance gma of the differential pair formed by the transistors M2 and M3. This can be expressed by the following equation (10):

$$A1=gma\cdot(1-R3\cdot gm8)/gm8 \quad (10).$$

Here, if gm8 is sufficiently large, (1−R3·gm8)/gm8 can be approximately equal to −R3, and the gain A1 can be expressed by the following equation (11):

$$A1=-gma\cdot R3 \quad (11).$$

As described above, in the series regulator 1, the resistor R3 is connected between the drain of the transistor M8 where the control signal is output and its gate. As expressed by the equation (9), the resistance of the resistor R3 can be set at an arbitrary value because it is not related with the resistance Ry. Thus, as expressed by the equation (11), a high gain A1 can be provided by increasing the resistance of the resistor R3 without changing the value of the transconductance gma. Also, since the value of the transconductance gma need not be changed, increase of bias current can be prevented or restrained. The resistance Ry can be reduced regardless of the gain A1. As a result, the pole of the node Y can be provided with a high frequency. Therefore, the phase margin increases and stability can be secured even when the load resistance $R_L$ is small (when the load is heavy).

Figure 3:
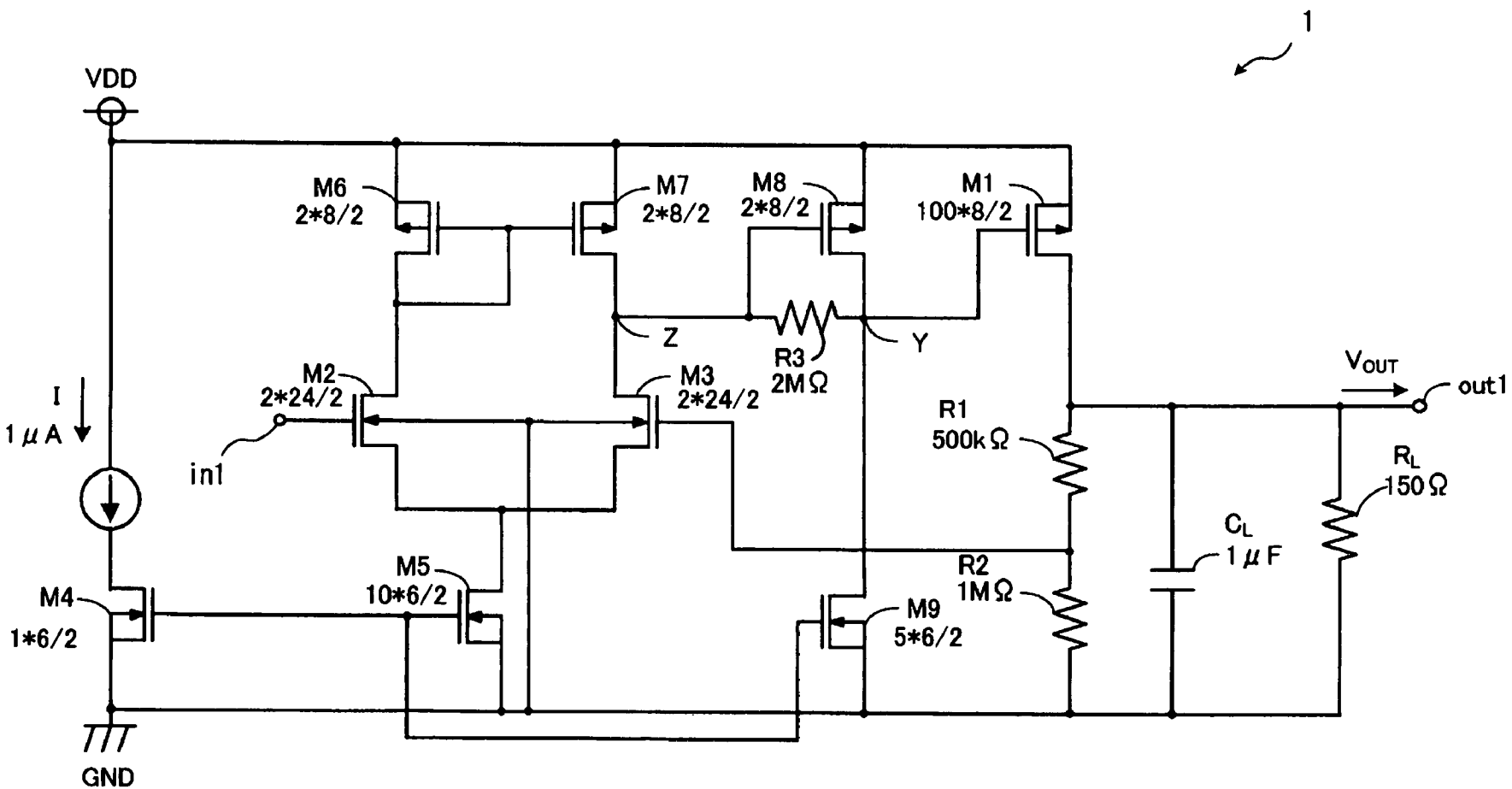
FIG. 3 is a circuit diagram showing an example with exemplary device parameters of the embodiment of FIG. 1.

FIG. 3 is a circuit diagram showing an example with specific device parameters of the series regulator shown in FIG. 1. The numerals placed near each transistor in FIG. 3 represent the number of units and the size of the transistor (m (units)×W (gate width) [μm]/L (gate length) [μm]). The resistance value of the resistor R3 is set at 2 MΩ.

Figure 4A:
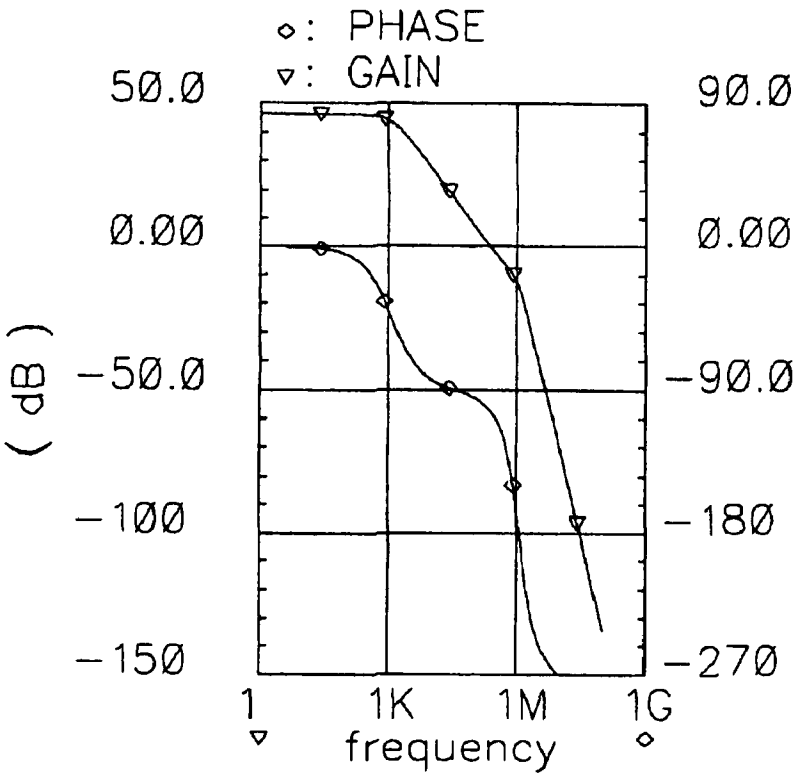
FIG. 4A is a graph showing the characteristics of a feedback loop in the series regulator of FIG. 1.
Figure 4B:
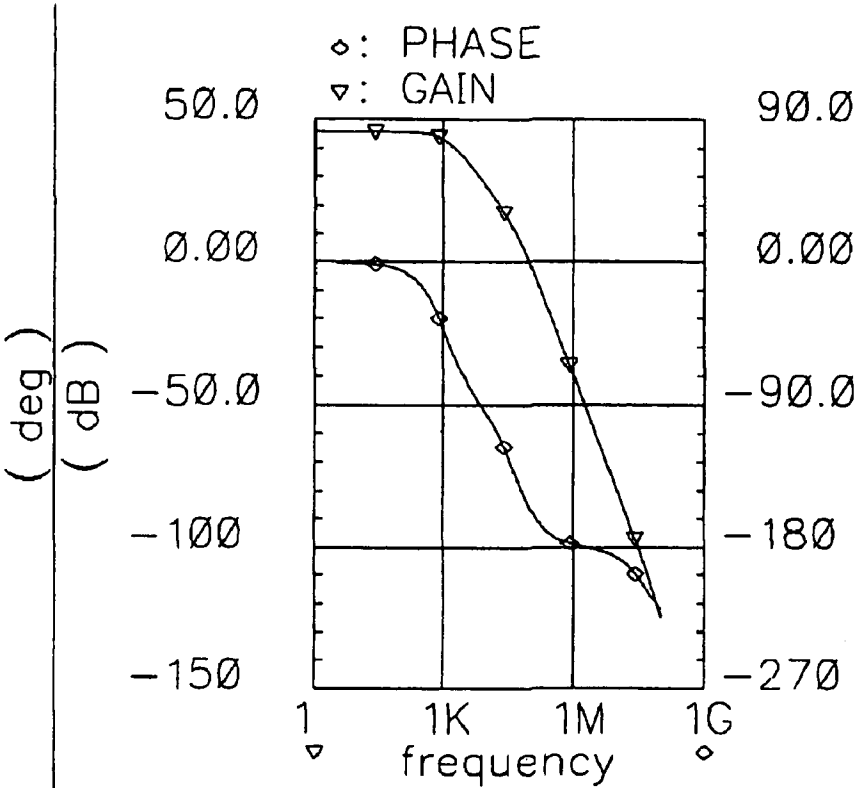
FIG. 4B is a graph showing the characteristics of a feedback loop in a series regulator of FIG. 8.
Figure 8:
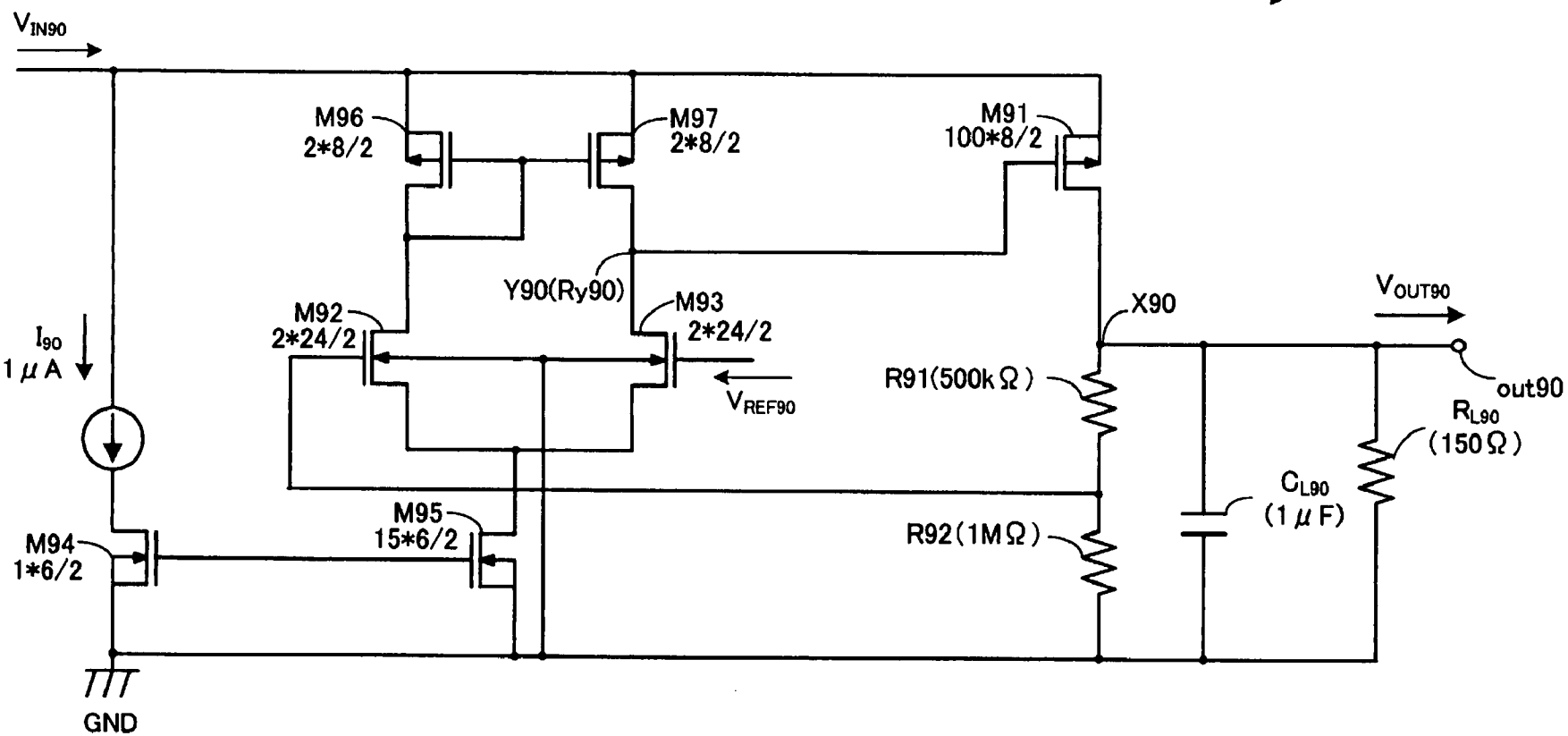
FIG. 8 (PRIOR ART)
FIG. 8 is a circuit diagram showing a conventional series regulator.
Figure 9:
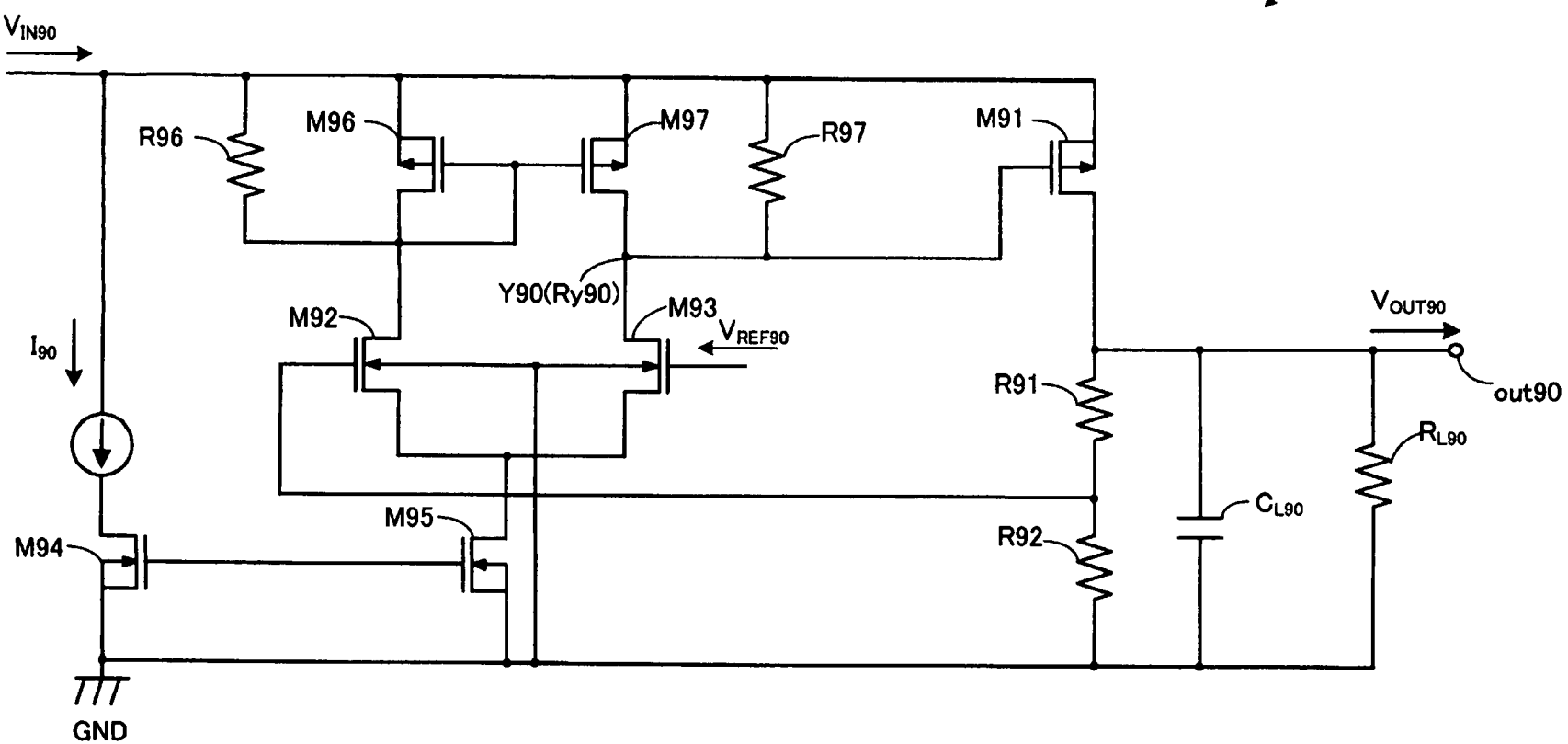
FIG. 9 (PRIOR ART)
FIG. 9 is a circuit diagram showing another conventional series regulator.

FIG. 4A is a graph showing the characteristics of a feedback loop in the series regulator according to the first embodiment. FIG. 4B is a graph showing the characteristics of a feedback loop in the series regulator shown in FIG. 8. Here, $R_L=R_{L90}$=150Ω holds and the output current is set at 10 mA in both cases (equivalent to $V_{REF}$=1.0 V, $V_{OUT}$=1.5 V). As shown in FIGS. 4A and 4B, the series regulator 1 according to the first embodiment can improve the phase margin and provide a high DC gain, compared with the series regulator 90.

Figure 5:
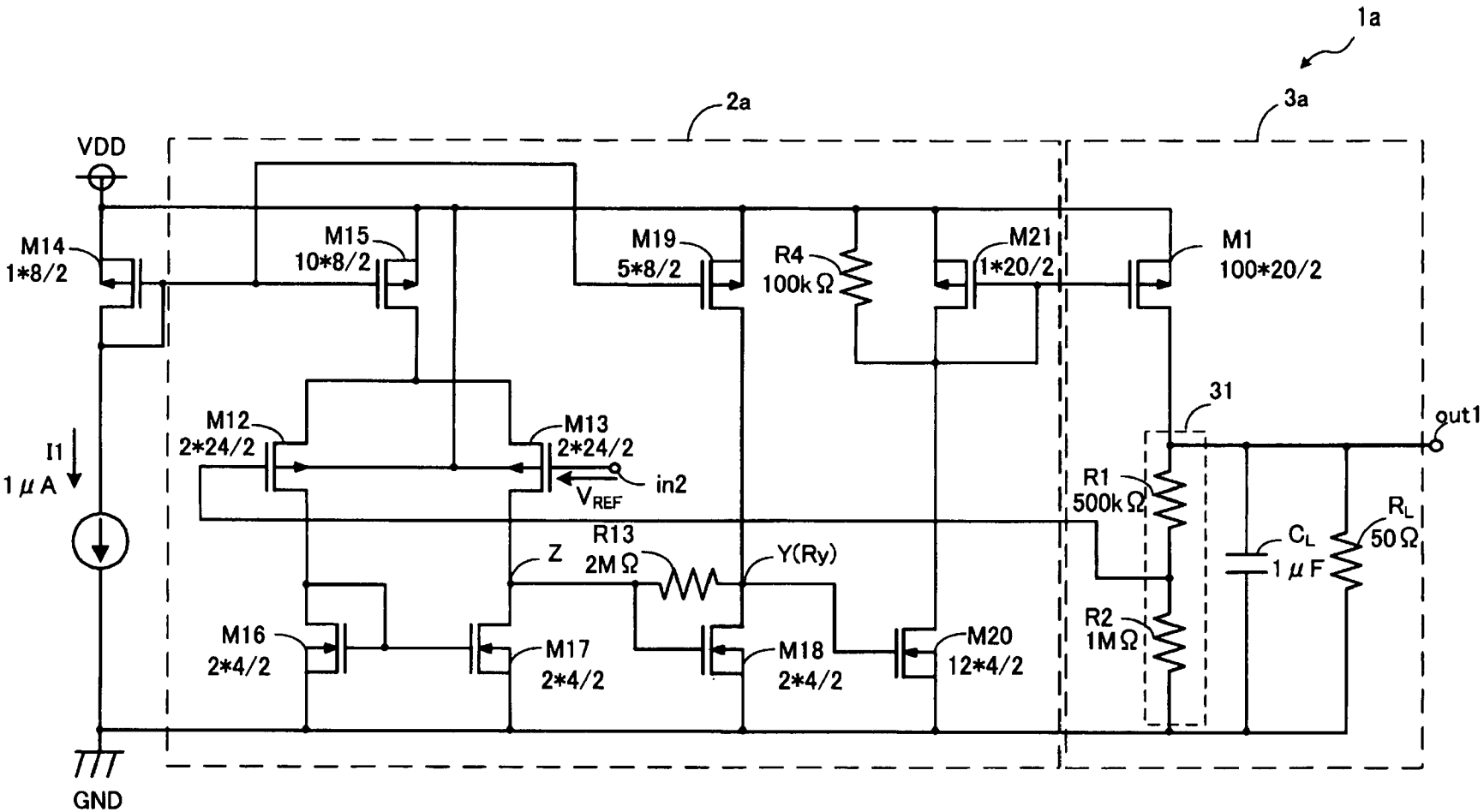
FIG. 5 is a circuit diagram showing a second embodiment of a series regulator according to the present invention.

Referring to FIG. 5, a second embodiment of a series regulator 1*a* will be described. Hereinafter, the difference between a series regulator la according to the second embodiment and the above-described first embodiment will be mainly described. The series regulator 1*a* has a differential amplifier circuit 2*a* and an output stage 3*a*. The differential amplifier circuit 2*a* has a differential input stage including a PMOS transistor M15, PMOS transistors M12 and M13 that form a differential pair, and a current mirror circuit formed by NMOS transistors M16 and M17. The differential amplifier circuit 2*a* also has a first amplification stage including an NMOS transistor M18 that has a resistor R13 connected between its gate and drain and that has its drain connected to a node Y, and a PMOS transistor M19 that supplies a current proportional to a constant current I1 to the transistor M18. The differential amplifier circuit 2*a* also has a second amplification stage including an NMOS transistor M20 that has its gate connected to the node Y, and a PMOS transistor M21 and a resistor R4 that are connected in parallel. The connecting part between the NMOS transistor M18 and the PMOS transistor M19 serves as an output terminal (output part) of the first amplification stage. The PMOS transistor M21 of the second amplification stage, together with an output control transistor M1, forms a current mirror circuit. A PMOS transistor M15, together with a PMOS transistor M14, forms a current mirror and supplies a current proportional to the constant current I1 to the differential input stage.

The series regulator 1*a* has a structure where the PMOS transistor and the NMOS transistor of the series regulator 1 of the first embodiment are replaced by each other and where a second amplification stage is additionally provided. A divided voltage is supplied to the gate of the transistor M12. A reference voltage $V_{REF}$ is supplied to an input terminal in2 of the transistor M13.

Figure 6:
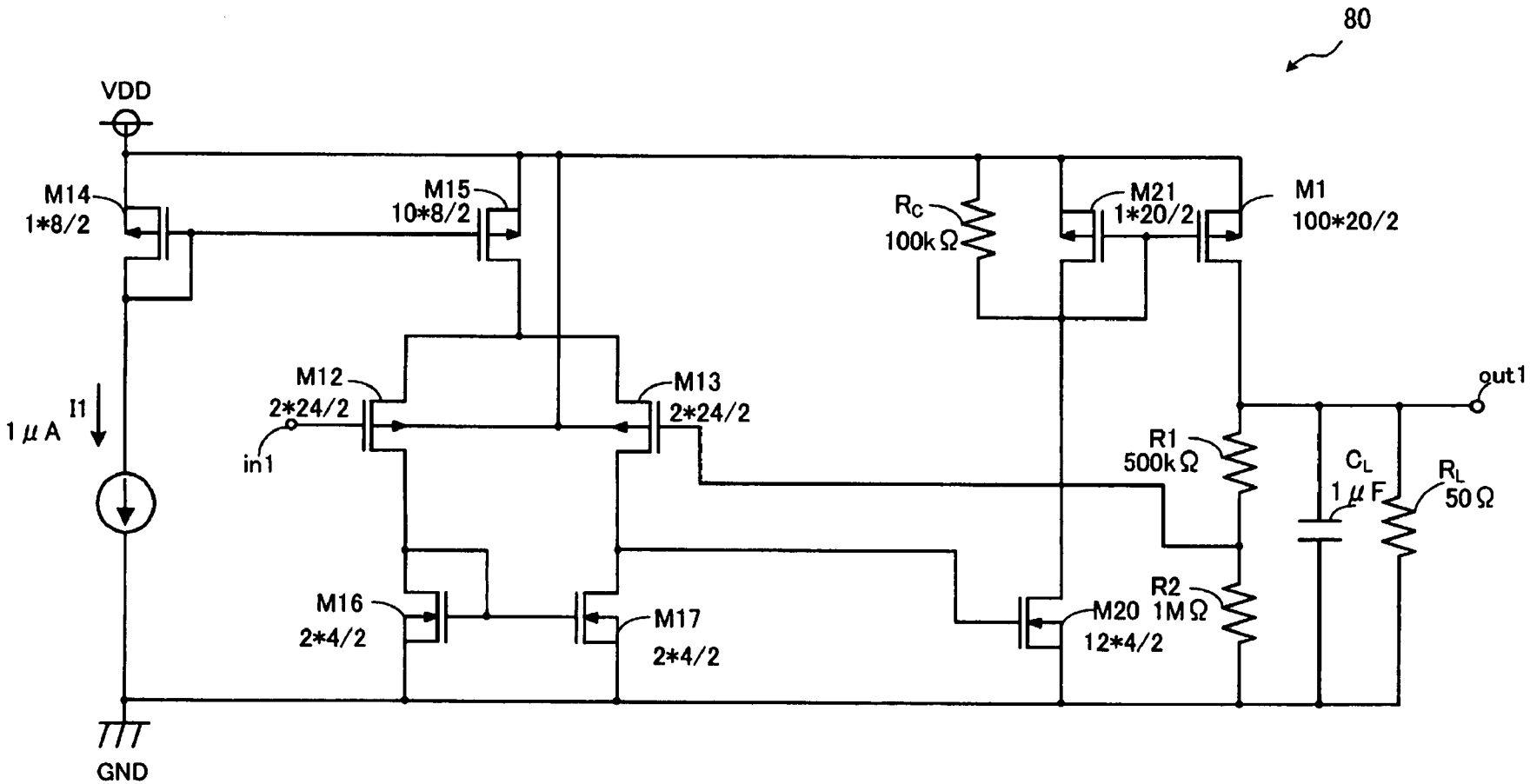
FIG. 6 is a circuit diagram showing a comparative series regulator in comparative example to the second embodiment.

FIG. 6 is a circuit diagram showing a series regulator 80 as a comparative example. In FIG. 6, the parts similar to those of the series regulator 1*a* are denoted by the same numerals to make the description easier to understand. The series regulator 80 of FIG. 6 does not have the transistors M18, M19 and the resistor R13. Therefore, it has a single amplification stage, which is different from the series regulator 1*a*.

Figure 7B:
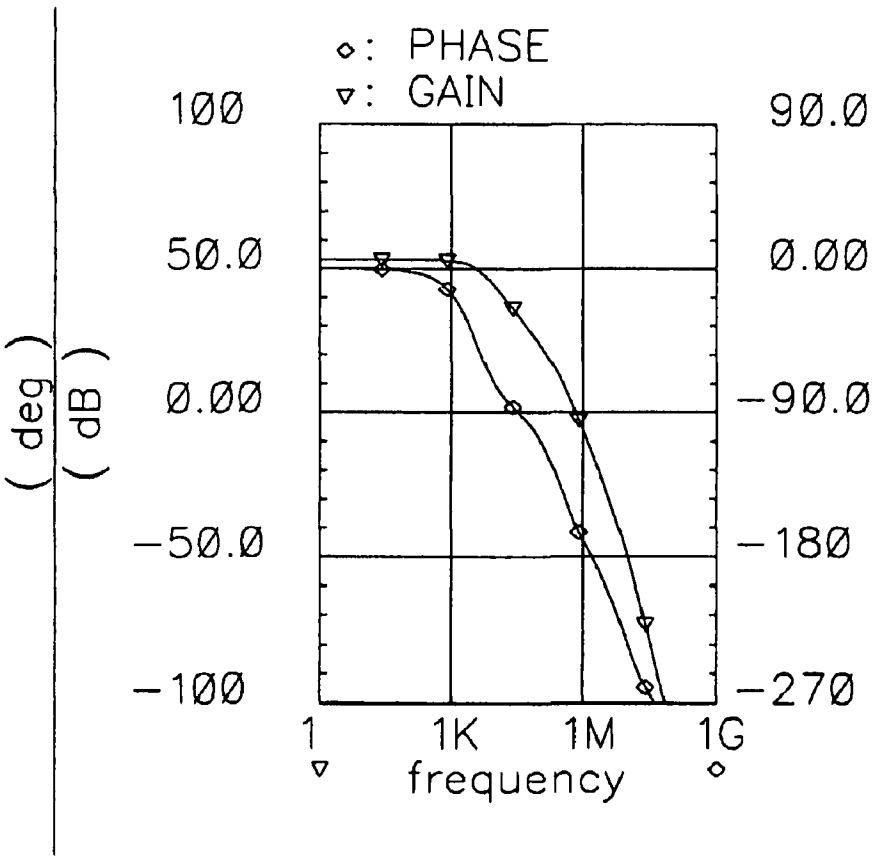
FIG. 7B is a graph showing the characteristics of a feedback loop in the series regulator of FIG. 6.
Figure 7A:
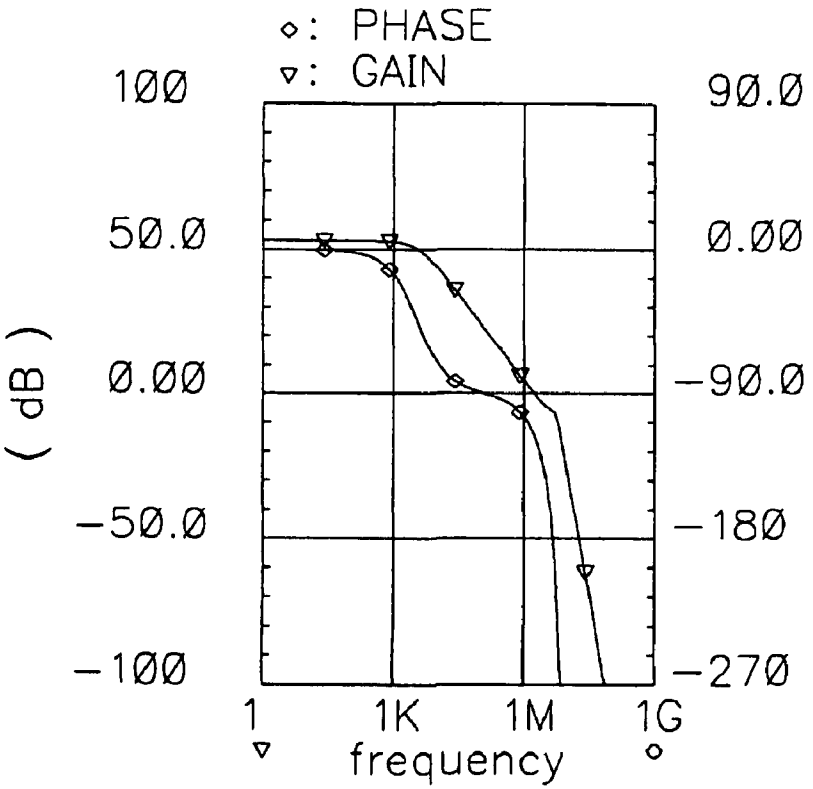
FIG. 7A is a graph showing the characteristics of a feedback loop in the series regulator of FIG. 5.

FIG. 7A is a graph showing the characteristics of a feedback loop in the series regulator 1*a* of the second embodiment. FIG. 7B is a graph showing the characteristics of a feedback loop in the series regulator 80 of FIG. 6. Here, $R_L$=50Ω (output current 30 mA) is set in both the series regulator 1*a* and the series regulator 80 (equivalent to $V_{REF}$=1.0 V, $V_{OUT}$=1.5 V). As shown in FIGS. 7A and 7B, the series regulator 1*a* can improve the phase margin and provide a high DC gain, compared with the series regulator 80.

The series regulator 1*a* according to the second embodiment has the effect similar to that of the series regulator 1 according to the first embodiment.

In the present series regulator, since a resistor with a predetermined resistance is connected between the drain of the MOS transistor where the control signal is output and the gate, the resistance of the output part of the amplification stage (input part to the output control transistor) can be reduced regardless of the gain of the differential amplifier circuit.

Further, since a resistor with a predetermined resistance is connected between the drain and gate of the MOS transistor, where the control signal is output, of the amplification stage of the differential amplifier circuit, the gain of the differential amplifier circuit can be increased regardless of the resistance value of the output part of the amplification stage. Moreover, increase of bias current can be prevented or restrained.

Also, since the resistance of the output part can be reduced without affecting the gain of the differential amplifier circuit, the pole of the output part can be provided with a high frequency and the phase margin increases. Thus, it is possible to apply a high DC gain and to secure stability even when the load is heavy.

The series regulator according to this invention is described above with reference to the embodiments shown in the drawings. However, this invention is not limited to these embodiments and the construction of each part can be replaced by any construction having the similar functions. Also, any other structural element may be additional provided in this invention. In this respect, the series regulator can include a combination of any two or more structural elements (features) of the above embodiments.

While the present invention has been particularly shown and described with reference to particular embodiments, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priority to, JP PA 2005-142071, filed on 16 May 2005. The disclosure of the priority application, in its entirety, including the drawings, claims, and the specification thereof, is incorporated herein by reference.

What is claimed is:

1. A series regulator for supplying a stable output voltage to a load, the series regulator comprising:

an output control transistor that supplies the output voltage in accordance with a control signal;

a voltage divider circuit that divides the output voltage and outputs the divided voltage; and a differential amplifier circuit that outputs the control signal to the output control transistor in accordance with a differential voltage of difference between a preset reference voltage and the divided voltage output from the voltage divider circuit, wherein the differential amplifier circuit includes:

a differential input stage for detecting the differential voltage between the reference voltage and the divided voltage output from the voltage divider circuit; and an amplification stage having a first MOS transistor and a resistor having a predetermined resistance connected to the gate and the drain of the first MOS transistor, and a constant-current circuit connected in series with the first MOS transistor, wherein the differential input stage includes a differential pair of second and third MOS transistors, with the drain of one of the second or third MOS transistor directly connected to the gate of the first MOS transistor, wherein a connecting part between the first MOS transistor and the constant-current circuit serves as an output terminal of the amplification stage, wherein the amplification stage converts current output from the differential input stage to a voltage to generate the control signal, which is output to the output control transistor, wherein if the preset reference voltage is larger than the divided voltage, the amplification stage generates the control signal for increasing the output voltage to be output by the output control transistor, wherein if the divided voltage is larger than the preset reference voltage, the amplification stage generates the control signal for decreasing the output voltage to be output by the output control transistor, and wherein only the amplification stage exclusively outputs the control signal to the output control transistor when a differential voltage exists between the preset reference voltage and the divided voltage.

2. The series regulator according to claim 1, wherein the sources of the second and third MOS transistors are coupled together, and wherein the reference voltage and the divided voltage output from the voltage divider circuit are input to the respective gates of the second and third MOS transistors to detect the differential voltage therebetween.

3. A differential amplifier circuit for outputting a differential signal, comprising:

a differential input stage for detecting a differential voltage between two voltage sources; and an amplification stage having a first MOS transistor and a resistor having a predetermined resistance connected to the gate and the drain of the first MOS transistor, and a constant-current circuit connected in series with the first MOS transistor, wherein the differential input stage includes a differential pair of second and third MOS transistors, with the drain of one of the second or third MOS transistor directly connected to the gate of the first MOS transistor, wherein a connecting part between the first MOS transistor and the constant-current circuit serves as an output terminal of the amplification stage, wherein the amplification stage converts current output from the differential input stage to a voltage to generate a control signal for controlling an output control transistor that outputs an output voltage, wherein if the voltage from one of the two voltage sources is a larger than the voltage from the other voltage source, the amplification stage outputs the control signal for increasing the output voltage to be output by the output control transistor, wherein if the voltage from the other voltage source is larger than the voltage from the one voltage source, the amplification stage outputs the control signal for decreasing the output voltage to be output by the output control transistor, and wherein only the amplification stage exclusively outputs the control signal to the output control transistor when a differential voltage exists between the two voltage sources.

4. The differential amplifier circuit according to claim 3, wherein the sources of the second and third MOS transistors are coupled together, and wherein the two voltage sources are input to the respective gates of the second and third MOS transistors to detect the differential voltage therebetween.

* * * * *